US005131147A

United States Patent [19]

Plevyak et al.

[11] Patent Number: 5,131,147

[45] Date of Patent: Jul. 21, 1992

[54] RECIPROCAL CAM-POWERED RAZOR

[76] Inventors: Joseph B. Plevyak; Anna S. Plevyak, both of RD. 3, Box 816, Smith Hill Rd., Newton, N.J. 07860

[21] Appl. No.: 720,200

[22] Filed: Jun. 24, 1991

[51] Int. Cl.[5] ..... B26B 19/02

[52] U.S. Cl. ..... 30/43.92; 30/346.51

[58] Field of Search ..... 30/43.91, 43.92, 44, 30/45, 46, 346.51, 216

[56] References Cited

U.S. PATENT DOCUMENTS

| | | | |
|---|---|---|---|
| 2,253,195 | 8/1941 | Oster | 30/43.92 |
| 2,661,532 | 12/1953 | Salz | 30/43.92 |
| 2,819,518 | 1/1958 | Lussier | 30/43.92 X |
| 3,858,314 | 1/1975 | Brenneman et al. | 30/43.92 |

*Primary Examiner*—Douglas D. Watts

*Attorney, Agent, or Firm*—LaForest S. Saulsbury

[57] ABSTRACT

A reciprocal cam-powered razor in which the drive is effected through the use of multi-sided triangular section cams. Each cam has an odd number of cam faces and corresponding apices, beginning with a 3-face cam as of isosceles triangle of two equal length sides and with an apex in a normal or perpendicular line from a mid-length of the cam face. Other cams can be a 5-face or a 7-face and so on with odd numbers thereof. The inner sleeve of an inner and outer hair cutting sleeve head has a slot with longitudinally-spaced side edges against which apices of the respective cams work to reciprocate the inner sleeve in a multiple manner for but a single revolution of the drive shaft. Normal lines between each side and its apex will locate the axial center with which the cam will be co-aligned with drive axis of the handle body drive shaft. Arrangements are included wherein the cutting heads will be offset to permit some 280 degrees of the circumferential surface available for contact with the skin without interference of the handle body while carrying out the shaving operation. The multiple-faced cam has also been adapted for detachable cutting head attachments with the use of extension drive shafts within them. Provision has been made for the use of an axial drive shaft with several different cams to provide for a selection of different number of reciprocations of operation with one revolution of the drive shaft to render the razor more or less vibrator. The vibratory effect of these cams add a good feeling to the skin and direct hair into the cutting slots of the cutting head.

8 Claims, 4 Drawing Sheets 141
142
142'
143
143'
144
144"
145
146
147
148
148"
149
151
151'
152
153
154
155'
155"

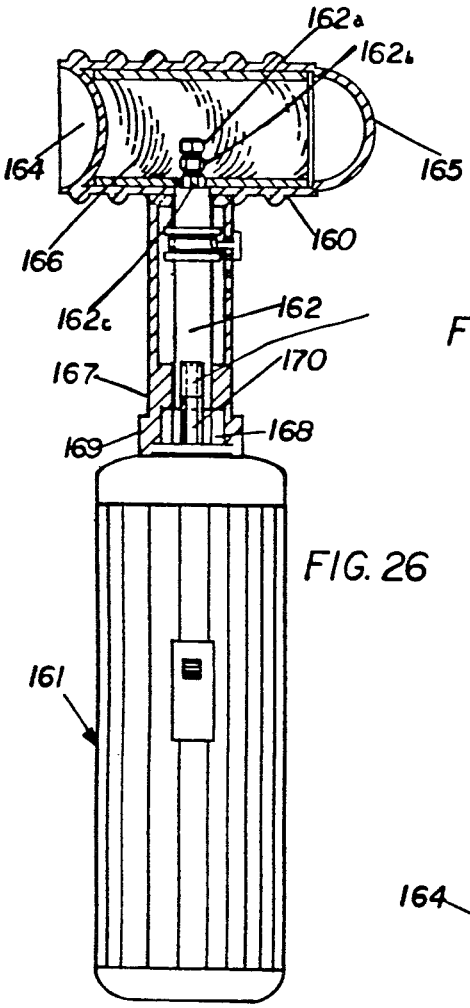
FIG. 26
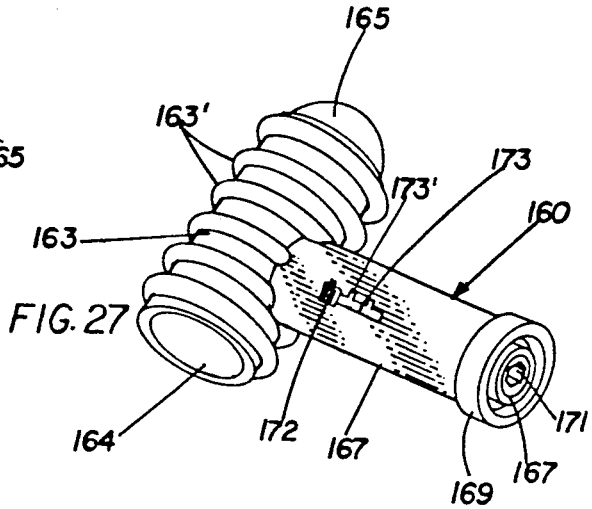
FIG. 27
FIG. 28
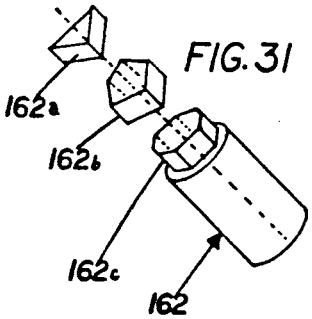
FIG. 31
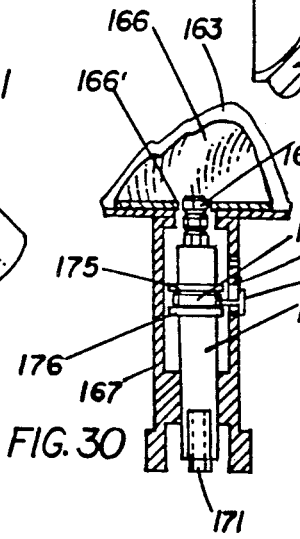
FIG. 30
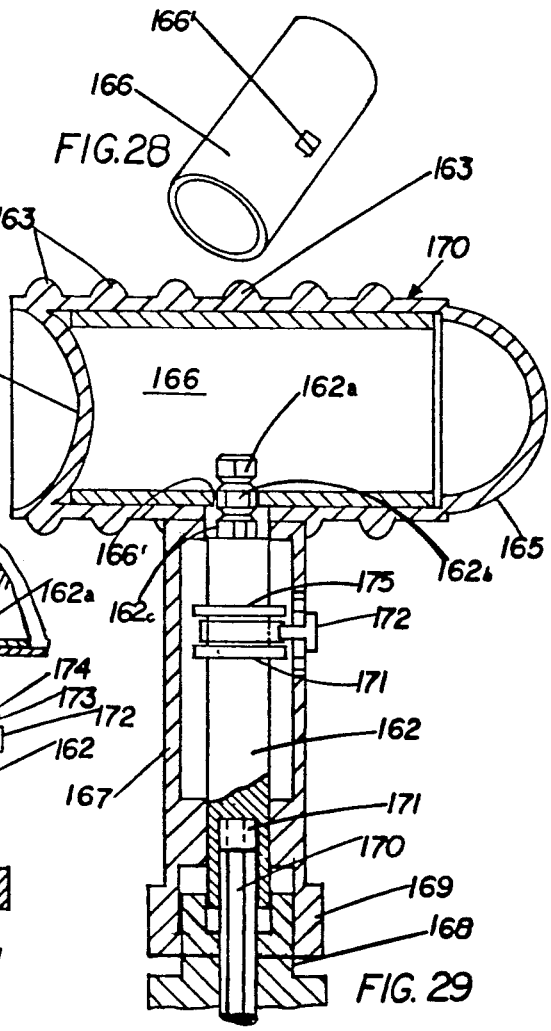
FIG. 29

RECIPROCAL CAM-POWERED RAZOR

This invention related to reciprocal razors and like hand-held devices and more particularly to a high speed drive mechanism therefor.

Normally, the reciprocation of safety razor heads and the like has been effected by the use of an eccentric pin on the end of a drive shaft working within a circular slot of the inner shearing sleeve to cut the hair that is extended through the slotted outer sleeve in which the inner sleeve is worked. For a complete rotation, an eccentric pin on the drive shaft makes one complete revolution of the shaft and causes but one complete reciprocation. Little or no massaging is had from such single reciprocation. In U.S. Pat. No. 2,590,452, an eccentric pin is used for reciprocation of a cutting sleeve, and there is but one complete reciprocation for a single revolution of the cam drive shaft. Separate drive shafts are provided for each of the inner and outer cutting sleeves and but one reciprocation of the sleeves relative to each other in one revolution of the drive shaft. Rather complicated for sure, but showing only typical solitary pin drives for either inner and outer sleeves. In U.S. Pat. No. 3,903,592, dual cams are used for full reciprocation one at each end of a motor drive shaft. In the U.S. Pat. No. 2,246,523, an offset cutting head is shown and a razor body to which different attachments may be applied for the different functions out without a multiple reciprocation of the inner cutting sleeve with out one revolution of the drive shaft.

It is, accordingly, the principal object of the present invention to provide a drive cam that will effect multiple reciprocation of a work element such as razor hair cutting sleeve upon a single revolution of the motor drive shaft whereby to increase the speed of operation.

It is another object of the invention to provide an electric safety razor with stepped up cutting speed that will thereby reduce the number of passes required to complete the shaving operation.

It is still another object of the invention to provide an electric safety razor that has increased speed to give a massaging effect along with the shaving operation and through its vibration cause hair to be directed into hair cutting slots.

It is a further object of the invention to provide an electric safety razor or the like device having a power-operated handle adapted for use with interchangeable heads whereby several differently functional heads may be used with the one power-operated handle body.

It is a still further object of the invention to provide a safety razor construction that will have offset cutting elements to allow for easy use of the razor and permit cutting of the hair over 280° or more of the surface of the contacting sleeve and maximum contact with the face.

Still further objects of the invention are to provide a safety razor with multiple reciprocation of the cutting or reciprocal element for a single revolution of its drive shaft, having the above objects in mind, in which the razor is formed on a minimum number of parts, easy to assemble and inexpensive to manufacture, having interchangeable heads and a battery motor and handle grip, of pleasing appearance, effective and efficient in operation.

A single solitary shaft that provides a geometric triangular configuration with an apex and diametrically-opposite flat sides to give relief to permit multiple reciprocation with but one revolution of the drive shaft. With the increased reciprocation, a massage effect is had as well as the cutting speed being increased.

For a better understanding of the invention, reference may be had to the following detailed description taken in connection with the accompanying drawing, in which FIGS. 1, 2 and 3 are fragmentary illustrative drawings of a drive cam of triangular shape operating in a square opening within an inner cutting blade and respectively the cam showing in three different positions of rotation to complete one full reciprocation.

FIG. 26 is an elevational view of the handle body similar to FIG. 21 but wherein the razor head has been replaced with a vibrator head and with a series of different stepped cams on the drive shaft extension in the vibrator attachment axially-adjustable to adjust for the different vibratory speeds and adjusted to the high speed cam.

FIG. 27 is a perspective view of the vibratory attachment removed from handle body and having a square cam open.

FIG. 28 is a perspective view of inner vibrator sleeve removed from the attachment to show the square work slot.

FIG. 29 is an enlarged vertical sectional view of the attachment similar to the showing of FIG. 26 but with the adjustment made for the use of the intermediate speed cam.

FIG. 30 is a fragmentary sectional view similar to FIG. 26 but with adjustment made to the low speed triangular cam.

FIG. 31 is a fragmentary exploded view of the cam portions separated from one another for illustrative purposes.

Figures 1, 2, 3, 4, 5, 6, 7, 8, 10, 11, 12, 13:
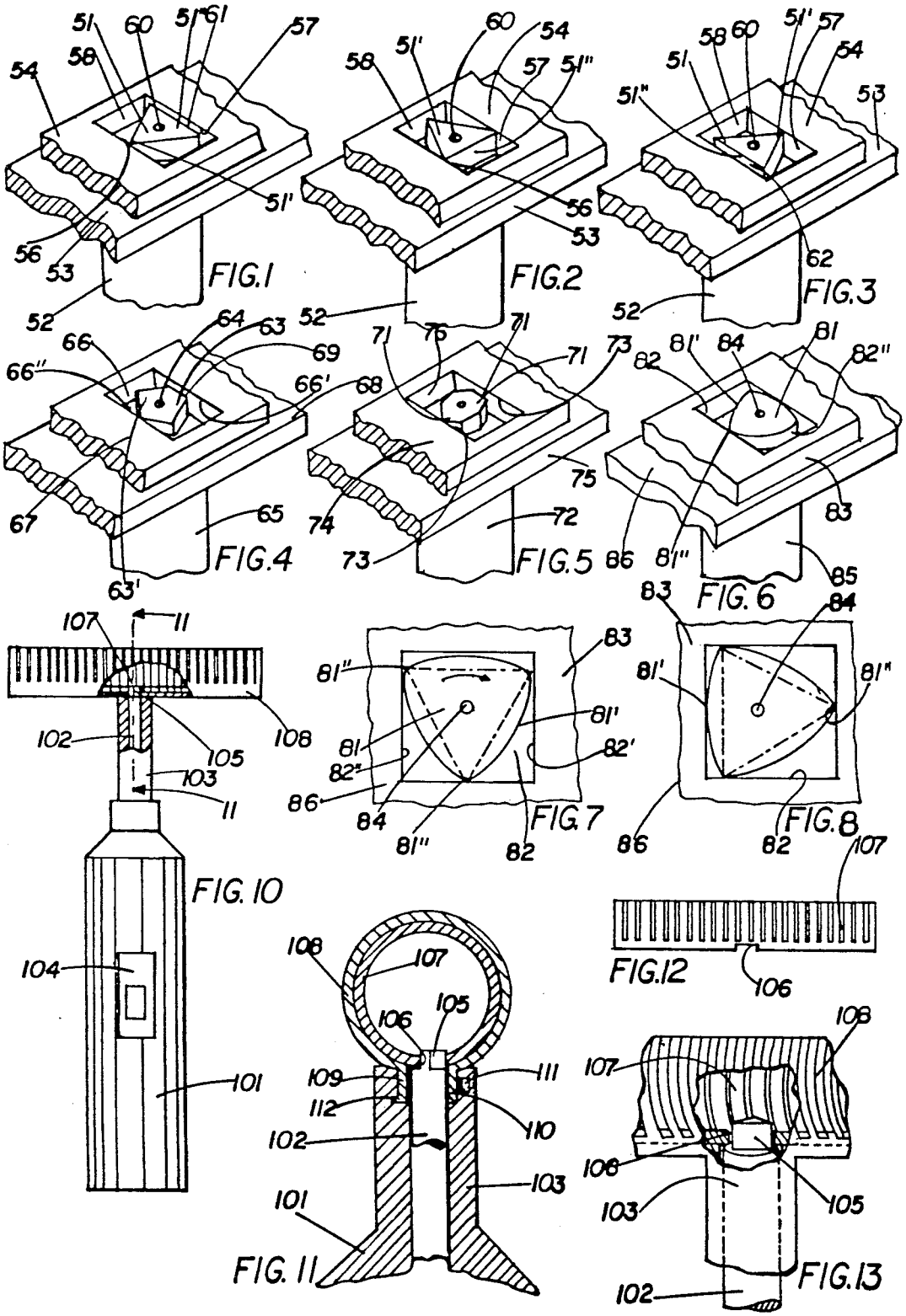
FIG. 4 is a fragmentary perspective view with illustration of the way a five-sided cam used for increased speed and reciprocations for one revolution of the drive shaft.
FIG. 5 is a fragmentary perspective view with illustration of the way a seven-sided cam that can be used for still further increased speed and reciprocations.
FIGS. 6, 7 and 8 are illustrative perspective and plan views showing a three-sided cam that has radial side face extensions.
FIG. 10 is a full elevational view of a battery-operated safety razor incorporating the cam drive of the present invention with portions broken away to show the cam drive connection with the inner cutting sleeve.
FIG. 11 is an enlarged fragmentary vertical sectional view of the razor of FIG. 10 taken on line 10—10 thereof.
FIG. 12 is a longitudinal elevational view of the inner cutting sleeve of FIGS. 10 and 11.
FIG. 13 is a enlarged fragmentary in perspective with portions broken away to look upon the full triangular cam head and drive shaft.

In FIGS. 1, 2, 3 and 9 there is best illustrated the principle on which cam 51 works to effect multiple reciprocations for a single revolution or the cam drive shaft. Such cam 51 would be an extension of a rotating shaft 52 drive, by a motor of an electric safety razor in a manner as will be described more in detail in connection with various razor constructions in which the cam 51 will be used. Generally, there will be an outer cutting sleeve, a fragment 53 of which is shown, and an inner fragment 54 of reciprocating sleeve that is reciprocal therewithin.

The cam 51 is in plan the shape of an isosceles triangle with three equal length sides and identical angles therebetween to serve as cam extensions for engagement with opposing walls 56 and 57 of a slot 58 in the inner cutting sleeve fragment 54. The edges are separating a distance of the length of one side of the triangle and short of a perpendicular distance between one side and the apex of a corresponding angle point 59. With lines drawn between all sides and their apex, their intersection provides an axial location for the triangular cam which will be determined and is the co-extend with the axis of the revolving drive shaft 52 as indicated by axial extension 60 by which the cam 51 is fixed to drive shaft 52. The apex or angle point 59 will alternately engage first one opposing wall then the other to effect the movement of the inner cutting sleeve in one lateral direction and the other.

If perpendicular or normal lines are drawn from the sides through the opposing apex of each isosceles triangle of the cam they will intersect at a common point to locate co-axial extension 60 for alignment with the axis of the drive shaft 52. The slot 58 has a measured length laterally equal to the length of one side between apices of the triangle that is greater than the length of the perpendicular distance of one side through its opposing apex. Accordingly, it will be seen that in FIG. 1, the inner sleeve fragment 54 has been moved to the left by point 51, leaving a space 61 behind it. An isosceles triangle is defined as one with two equal length sides.

On FIG. 2 the apex point 51 will have been turned ninety degrees so that its opposing side face 51" will be extended laterally and brought to an intermediate position in fragment 54, thereby moved partly and out of completion of its reciprocation. Another ninety degree turn for the full amount of 180 degrees the reciprocation will have been completed as can be viewed in FIG. 3 wherein the point 51' will be against the right side edge of slot 58 and the side face will have left space 62 from the left side edge of slot 58. There are other apex points in the cam and they would have followed the apex point 51 to make for other reciprocations. With all apex points working in conjunction with one another and with a sequence six single reciprocations will have been effected first against one side edge of the slot and then against the other edge of the slot; three complete reciprocations for one revolution of the triangular cam 51 will have been made. The apex points 51' are the high points of the cam.

In FIG. 4, there is displayed a similar arrangement to illustrate how five complete reciprocations can be had with a five-sided cam 63 and five apex points 63' and fixed by a coaxial extension to a drive shaft 65. This cam 63 works in a slot 66 and with its apex point 63 engagable with edges 66' and 66" of an inner sleeve fragment 67 working over an outer sleeve fragment 68. This five apex point cam 63 effects ten directional movements and five complete reciprocations. Each apex 63' is the high point of the cam striking an end edge 66' or 66" of the slot 63 and leaving a gap distance 69. An increased vibratory effect will accordingly be had over the the triangle cam 51 as the triangular cam 51 has had over the single extension of the ordinary drive for safety razors.

In FIG. 5, there is displayed a still similar arrangement to illustrate now seven complete reciprocations for one revolution of the seven-sided 71 cam can be had with seven apex points 71' and fixed to co-axial extension 64 of a drive shaft 72. This cam 71 works in a slot 73 of an inner sleeve fragment 74 with the corresponding cam points 71' of side faces 73" engagable with opposing end edges 73' and 73" in succession as the cam is rotated by its drive shaft 72 to leave gap 76. The inner sleeve fragment 74 is thereby reciprocated over outer sleeve fragment 75. This seven-point cam effects fourteen one directional movements and seven complete reciprocations and will be particularly effective where much vibratory action is desired along with speedier cutting action. Each apex point 71' is a high point on the cam 71 that strikes the respective opposing edges 73' and 73" in succession.

It should be noted that in all instances that the cams have odd numbers of apex high points and that each high point must correspond in a normal line through a side face on the cam. There is a difference in the length between apex points and between one apex normal with a corresponding side face. On the face of the cam there are odd number sets of triangles corresponding with each apex point and this must be as the operation is dependent upon the difference in distances between the perpendicular or normal with mid-point of a side face and between apex high points of the triangle. A cam with an even number of triangles would not work. The difference is necessary to allow for movement by the high point upon the inner sleeve as it engages the edges of the slot. The relief is provided in the gap distances between the corresponding side faces of the cam and the side edges of the slot as seen at 61 and 62 of FIGS. 1 and 3, at 69 of FIG. 4 and 76 of FIG. 5.

In FIGS. 6, 7 and 8, a single triangular cam 81 has been provided with rounded radically-expanded side face sections 81' between apex high points 81" to reduce wear on the high points and smooth out the rotation of the cam end edges 82' and 82" of slot 82 of inner cutting sleeve fragment 83. A relief spacing is not required with this radical extension form of cam. The cam is designed for equal space movements in both directions. The intersection of perpendicular lines through the apex points and mid-point of radial side faces of the cam locates axial extension 84 with drive shaft 85. In all the illustrations the inner sleeve fragment is reciprocated over an outer sleeve fragment 86. The axial connection 84 locates the pivot point more removed from the apex point 81" than the radial side face 81' and is in effect three lobes working on end edges of slot 82 acting in sequence thereon and in alternation with one another, whereby three complete reciprocations are effected with but one revolution of drive shaft 85 and cam 81.

In FIG. 7, there is shown in the plan that cam 81 has been turned but a part of a revolution from the position shown in FIG. 6 and in an intermediate position in part reciprocation in one direction. It is clear that the high points of the cam 81 are the apex points 81" of triangles and they in succession engage first one end edge of the slot 88 and continue on to engage the other end edge of the slot. This shaped cam 81 is particularly adapted for us with a square shape slot 82 so that reciprocation will be had in four directions by engagement with the four side edges of the slot. In FIG. 8, the cam is shown having turned through 18 degrees and having completed one reciprocation from the showing in FIG. 6 to FIG. 8. There will have been three completed reciprocations with a full one revolution of the cam 81. The length of the slot 82 must be the distance between apex points 81" along the radial face 81'. It should be apparent that the lengths of the slots are all of a distance measured between apex high points.

Figures 9, 14, 15, 16, 17, 18, 19, 20:
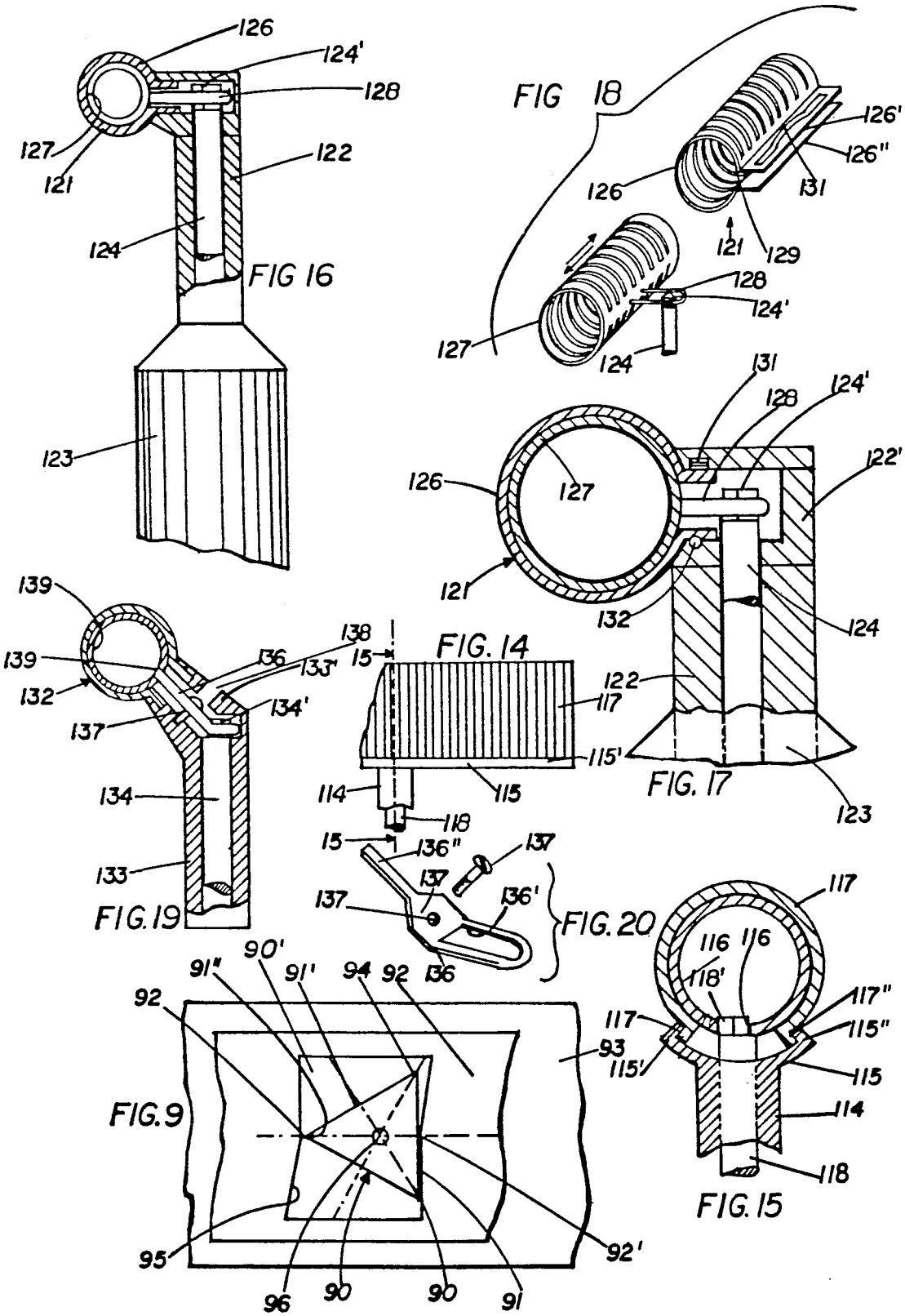
FIG. 9 is an illustrative plan view of a triangular-shaped flat face cam that works in a slot having relieved end edges to accommodate the apex high points for movement of the inner sleeve fragment.
FIG. 14 is a fragmentary elevational view of a cutting head of the electric razor showing a modified way for securing the outer cutting sleeve to razor body stem extension.
FIG. 15 is a vertical sectional view of FIG. 15 taken on line 15—15 thereof.
FIG. 16 is a fragmentary elevational view of a modified form of the invention with portions cut away in sections to show a laterally-extended cutting head and the drive connection therefor.
FIG. 17 is an enlarged vertical view of the cut away head portion of FIG. 16 to better show the drive cam connection with the laterally extending cutting head.
FIG. 18 is a collective perspective view of the cutting head assembly of FIGS. 16 and 17.
FIG. 19 is a fragmentary vertical sectional view of another modified form of the invention having its cutting head assembly extending in an inclined manner utilizing a pivotal drive connection between the cam and the inner sleeve.
FIG. 20 is a collective perspective view of the pivotal drive connection for the form of the invention shown in FIG. 19.

In FIG. 9, triangular-shaped cam 90 like of FIGS. 1, 2 and 3 has been used and relief has been made in the end edges of slot 91 in inner sleeve fragment 92 that is worked over outer sleeve fragment 93. The relief is a small angle cut 94 from a mid-point 92' on one end edge 91' of slot 91 and a similar small angle cut 95 from a midpoint 91" but in opposite extent therefrom. The distance from one edge of the slot to the other edge and between midpoint 92' and 92" is the nominal normal distance of one side face 90' through its opposing apex point 91". The relief cuts 94 and 95 accommodate the high points 91" of the cam and will reduce their wear. The dot and dash normal lines through the side faces and corresponding apices locate the axis of the cam to be co-designed with drive shaft axis.

In FIGS. 10 to 13, inclusive, is shown one adaptation of the triangular cam is an electric safety razor including a handle body 101 in which will be housed a battery and a small electric motor that drives a central shaft 102 that extends outwardly through a stem 103. A switch 104 will control the operation of the electric motor and the drive shaft 102. On the outer end of the drive shaft 102 is a triangular cam extension 105 that extends into a slot 106 in an inner cutting sleeve 107, and is reciprocal in an outer split cutting sleeve 108 to effect the cutting of hair as the razor is applied to skin of the user. The sleeves are slit to provide cutting rings that override one another to effect the showing operation. The blades of at least one of the sleeves are provided with a bevel to prevent the jamming of the sleeves for hair clippings and the cutting edges cleared. As the inner sleeve is reciprocated, the cam extension 105 is axially centered with the axis of the drive shaft in the manner as set forth in the description illustrative of FIGS. 1, 2 and 3 and through the intersection of lines normal to the side faces and corresponding apices of the triangle.

The outer slit sleeve 108 is severed throughout its length to have a spring tight fit over the inner sleeve 107 as best viewed in FIG. 11 and has depending projections 109 and 110 adapted to be snap fitted into the recessed end of the razor body stem extension 103 and restrained by a spring 111 and an end projection 112. With all parts assembled and switch 104 turned on, three complete back and forth reciprocations of the inner sleeve will have been made with but a single revolution of the motor driven shaft 102. Vibration of the cutting head aids in directing the hair into slots for a fast, close and soothing shave.

For an alternative spring tight manner of connecting the outer cutting sleeve to the razor body extension, see FIGS. 14 and 15. To a sleeve extension 114 there is provided an upwardly arcuate section transverse portion 115 into which are assembled inner and outer sleeves 116 and 117 in a spring tight manner. The outer sleeve 117 is slit and has opposing transverse running projections 117' and 117" adapted to be received by respective corresponding projections 115' and 115" of the arcuate section transverse portion 115 integrally formed on the body stem or sleeve extension 114. The assembled cutting sleeves will be slid into place from an open end of the transverse portion 115.

The inner cutting sleeve 116 has a bottom working slot 116 into a triangular cam extension 118' of a drive shaft 118 which extends to work the sleeve and effect cutting action between the sleeves with multiple reciprocations of the inner sleeve for a single rotation of the drive shaft 118 again in the manner described above herein.

In FIGS. 16 and 17 a modification is shown wherein the cutting sleeve assembly 121 extends laterally at right angles from the drive shaft 122 containing the stem from handle body 123 that contains battery and motor for effecting rotations of an enclosed drive shaft 124. As best viewed in FIG. 16, the cutting head assembly 121 includes an outer cutting sleeve 126 that is slit to have springiness to be tight fitted about an inner reciprocal cutting sleeve 127 from which there extends a U-shaped member 128. A multiple reciprocating cam extension 124' extends into the U-shaped member 128 to effect the multiple reciprocation of the inner sleeve 127 with but one revolution of the drive shaft 124.

The outer cutting sleeve 126 is slit at 129, FIG. 18, and from opposing slit edges are respective attaching flanges 120' and 126" that slide into a transverse stem extension 122' and retained therein by a leaf spring 131 and a pin projection engagable respectively with respective flanges 126' and 126". It should be apparent that as the shaft 124 is rotated and with the use of the triangular cam 124' there will be three full reciprocations for each revolution of the drive shaft 124. With the laterally extended head 121, easier use of the razor and surface engagement of the head with face skin ensures a clean shaving operation.

In FIGS. 19 and 20, there is shown still another modification of a laterally offset form similar to the form shown in FIG. 16 but wherein a cutting head assembly 132 that is detachably connected to an inclined stem projection 133' of drive shaft stem 133 that contains a rotatable drive shaft 134 with a triangular cam extension 134' adapted to give multiple reciprocations from a single revolution of the drive shaft. Within the inclined stem projection 135' is a pivot arm 136 pivotally connected thereto by a screw 137 accessible through a hole 138 in inclined projection 133'. The screw 137 passes through a hole 137 in the pivot arm 136 and into the interior of the projection.

The pivot arm 136 has a horizontal slotted portion 136' upwardly from which there extends in an inclined manner an extension 136" that works in a slot 139' in inner sleeve 139 of the cutting head assembly 132. The slotted portion 136' receives the triangular cam extension 134' so that reciprocal motion is imparted to the pivot arm 136 for transfer to the inner sleeve 139 to effect a shaving operation. With the cutting head so inclined relative to the stem and handle body of the razor more of the surface of cutting head may be accessible for easy use upon the face skin.

In FIGS. 21 to 25 inclusive, there is shown a detachable head and drive stem assembly 141 for connection with a handle body 142 with use of a bayonet slot coupling part 143' and handle body 143. The purpose is to provide a handle body to which other types of reciprocation heads may be attached, replacing one for another as will be apparent with the description of another modification next made herein. This attachment includes its own drive shaft 144 in a stem 145 to the outer end of which an assembly of inner and outer hair cutting sleeves 146 and 147 is fixed.

This sleeve assembly differs from the sleeve assemblies that have thus far been described, in that the inner coupling sleeve 146 is slit to have a spring tight fit within outer sleeve 147. In this form, outer sleeve 147 has the usual series of cutting blades that are to be joined together in spaced relationship with one another and connected to a transversely extending bar 148 rigidly connected to the outer and of the snort stem 145. The slit inner cutting sleeve is slit at 148 and is biased to expand against the interior surface of the outer sleeve for its series of blades to have shearing action with the blades of the outer sleeve and reciprocal movement of the inner sleeve within the outer sleeve. The blades' edges of either on the inner or outer sleeve are angled or beveled to prevent interference with one another and jamming reciprocating movement.

The inner cutting sleeve 146 is provided with closed edges 148' and 148" along respective opposing edges of the slit opening 148. With the edges drawn together within the outer sleeve 147, the slit 148 will be substantially closed and rigidly retained. Within the respective edges 148' and 148" are respective opposing notches which when the edges are drawn together provide a full operating slot 146' to receive a triangular drive extension 144' with its multiple apex points and side faces adapted to work therein and reciprocate the inner sleeve 146 within outer cutting sleeve 147. The split inner cutting sleeve 146 is slightly expanded and offer self-imposed pressure on the inner face of the outer cutting sleeve 147 for a closer and cleaner shave to compensate for wear.

In the lower end of the attachment drive shaft 144 is a hexagonal section drive shaft receiving recess 144" for receiving a corresponding projection 151' on motor driven drive shaft 151 extending from motor 152 and driven in the usual manner through a closed switch 153 and by batteries 154. To secure the attachment, the coupling 142 has its inwardly extending projections 142' lowered into bayonet slots 155' and 155" and turned upon reduced diameter sleeve portion 143' of the handle body 143, while establishing the drive connection of motor shaft 151 with the shaft extension 144 within the attachment stem 144 and its triangular cam 144' whereby to effect multiple reciprocation of the inner sleeve 146 within the outer sleeve with each revolution of the coupled shafts 144 and 151.

Figures 21, 22, 23, 24, 25:
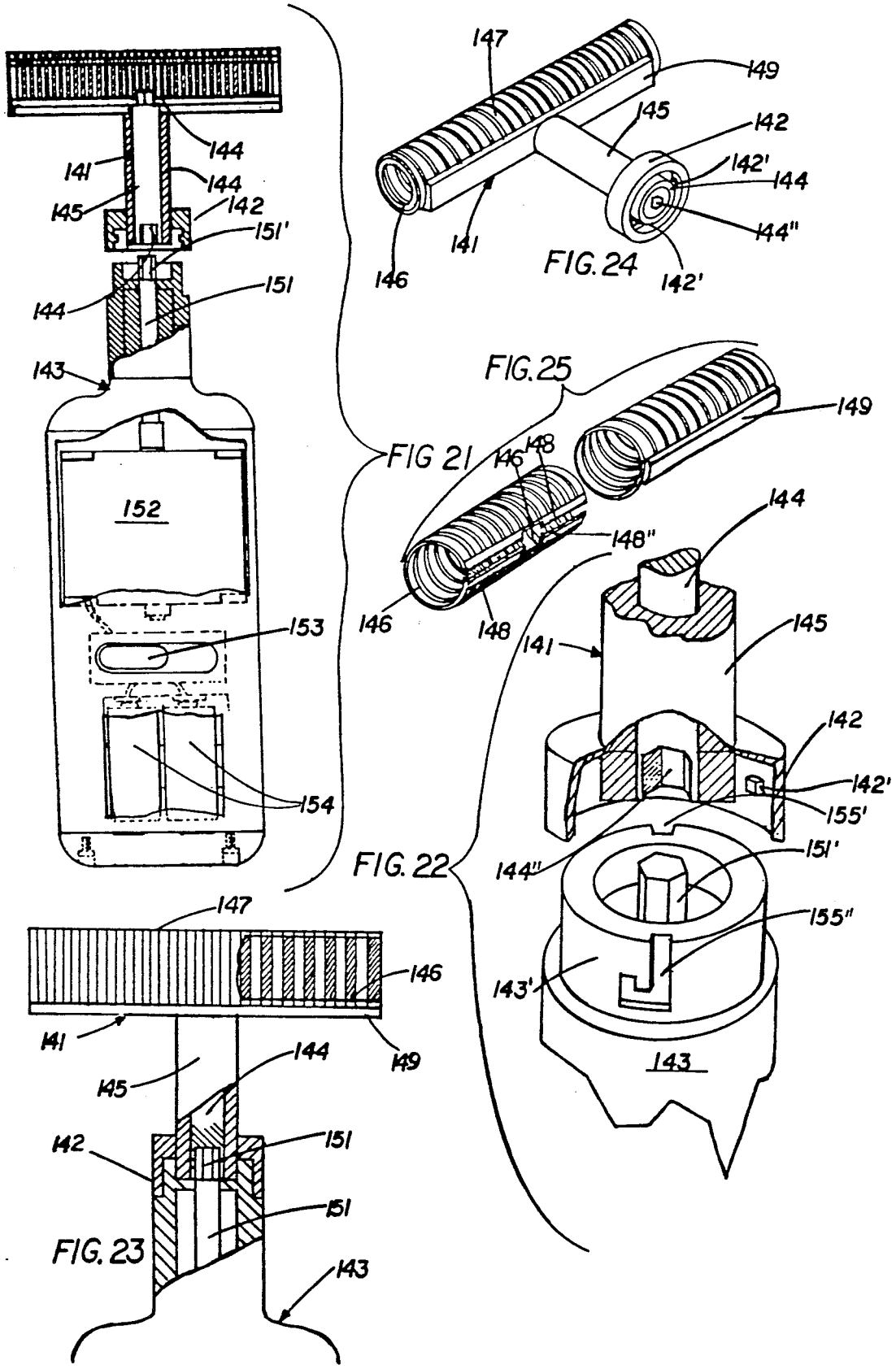
FIG. 21 is a fragmentary elevational and collective view of still another modified form of the invention in which detachable work head assemblies with their drive shaft can be replaced with one another upon the handle body having a battery-operated drive motor and attachable thereto by use of a bayonet slot connection.
FIG. 22 is an enlarged fragmentary collective view in perspective, of the bayonet slot detachable connection for the attachment of FIG. 21 with its battery operating razor handle.
FIG. 23 is a fragmentary sectional view of the razor cutting head attachment connected to the razor handle.
FIG. 24 is a perspective view of the razor cutting head attachment removed from the razor handle and looking upon the end of its bayonet connection.
FIG. 25 is a collective perspective view of the cutting head attachment with the inner cutting sleeve removed from the outer sleeve to show its construction.

In FIGS. 26 to 31, inclusive, there is shown a vibrating attachment 160 for use with a battery-powered handle body 161 to replace a razor cutting head attachment 141 of FIG. 21 and to connect the assembly into a vibrator. The attachment 160 includes a shaft extension 162 that has an assembly 162 of three multi-sided drive cam portions, **162*a*, 162*b* and 162*c*** having respectively three, five and seven side faces.

This attachment 160 has an external skin contacting sleeve 163 with axially-spaced peripheral projections 163' for more effective engagement with the skin. One end of the sleeve 163 is provided with a concave cap 164 and the other end has a convex cap 165, which is adapted to work respectively on raised and indented contours of the skin. Axially-workable within the contacting sleeve 163 is an inner sleeve 166 adapted for reciprocatory actions upon one of the drive cams of the extension being projected into a square opening 166' of the sleeve 166, with speed depending upon the particular one of cams **162*a*, 162*b* and 163*c*** that is used.

Depending from the outer sleeve 163 is an attaching stem 167 that houses the extension shaft 162 for axial adjustment therein to locate any one of the cams in the square opening 166' of the reciprocal inner sleeve 166. Extending upwardly from the handle body 161 is a sleeve portion 168 which has bayonet slots like in FIG. 22 to receive turnable coupling parts, FIGS. 26, 30 and 31. A drive shaft 170 extends up from the handle body which is of hexagonal section that is received in a corresponding axial hole 171 in the lower end of the extension drive shaft 162 of the attachment 160. The extension shaft 162 is axially-adjustable upon the body shaft 170 to locate the cams **162*a*, 162*b* and 162*c* in the square hole 166' of the inner sleeve 166. The apex points of the cams can act upon all four sides of the square opening to obtain a four-way reciprocation effect most desirable for an instrument of this type. The adjustment of the shaft 162 and cam group 162 is done by the use of a latch bar 172 that extends laterally through an elongated slot 173 having in one side a series of three notches into which the latch bar 172 will be turned to bold the shaft 162 in their axially-adjusted position. The latch bar 172 extends radially from a ring 174 that is loose on shaft 167 and is disposed between spaced flanges 175 and 176 on the shaft 162 to engage the flanges to axially adjust the shaft and cams. The FIGS. 26, 29 and 30 respectively show the respective cams 162*c*, 162*b* and 162*a*** in place to have fast intermediate and slow multiple vibrations for a single revolution of the drive shafts.

With more than one multiple faced cam aligned in sequence on the spindle extension shaft allows for increase in vibrations from low to high or decrease from high to low with a mere flick with finger the latch bar 172.

The cutting ring formations of either the inner or outer cutting sleeves will be formed at an angle to effect a good shearing action and uninterrupted movement to the reciprocation motion. The outer sleeve has a plurality of parallel cutting slots and the inner cutting sleeve has corresponding slots and cutting rings at angled and close mesh to effect shearing action upon hairs that pass through the slots of the outer sleeve and with reciprocating and radial motion of the inner sleeve within the outer sleeve, clippings of the hair are achieved gently and with ease up to some 280 degrees peripherally about the assembled cutting head. The reciprocal and vibratory motions have been effected through rotation of a drive shaft and multi-faced cams having apex points engaging the side edges of oblong or square openings in the inner sleeve. The number of reciprocations by the use of odd numbered cam faces cams without changing the speed of the spindle shaft and with but one revolution of the same. If the spindle shaft is rotated at 1000 rpm an ordinary single point cam would reciprocate 1000 times, three point 3000 times, five point 5000 times, a seven point cam 7000 times and so on.

In the vibrator attachment 161 of FIGS. 26 to 31, inclusive, massaging action results from the reciprocation of the inner sleeve, the same as with the shaver forms of the invention and this takes place for approximately 280° of circumference of the head of the attachment and through the convex and concave ends 164 and 165 of the massager attachment 161. The radial ridges 113' on the surface of the outer cylindrical sleeve 168 increase the massaging intensity.

It should be apparent that novel means has been provided for increasing the speed of operation of safety razors with the use of multi-side cams.

While various changes may be made in the detail construction, it shall be understood that such change shall be within the spirit and scope of the present invention as defined by the appended claim.

What is claimed is:

1. A reciprocal cam-powered razor comprising a handle body having a rotary drive shaft extending therefrom, a cutting sleeve head carrier-handle body and having an outer hair cutting sleeve and an inner cutting sleeve axially reciprocal therewithin, said inner sleeve having an open drive slot therein with axially-spaced opposing cam-engaging edges, said drive shaft having a geometrically-sectioned cam extension of odd number of side faces forming triangular areas, each with an apex normally-disposed from each side face and engagable in succession with the cam edges of inner sleeve slot, said cam extension being aligned with the axis of the drive shaft through the intersection of lines extending normal from the respective side faces and their corresponding apex and the spacing of the opposing cam-engaging edges of the slot in the inner sleeve being equal to the measured length of one of the equal sides of a triangular formation area and that is greater than the normal distance between the side face and its apex, whereby to effect multiple reciprocation of the inner sleeve within the outer sleeve for each revolution of the rotary drive shaft and its multi-side face cam extension.

2. A reciprocal cam-powered razor as defined in claim 1 and said cam faces of the cam extension having a rounded radius extensions taken from its corresponding apex and adapted to be accommodated within the spacing of the cam-engaging edges of the inner sleeve slot and to take up slack therebetween and provide for positive effectuation of the cam.

3. A reciprocal cam-powered razor as defined in claim 1 and the cam-engaging edges of the slot of the inner sleeve being cut away from intermediate their length to one end of the edge to relieve the edge for accommodation of the apices of the cam as movement of the inner sleeve is effected.

4. A reciprocal cam-powered as defined in claim 1 and said outer sleeve of the hair cutting head being slit and flanged along the slit edges and the inner cutting sleeve being closed when confined to the outer sleeve, said handle body having a stem extension for enclosing the drive shaft laterally-extending on the stem means for attaching the flange of the outer sleeve to the stem and overlying the cam-extension of the drive shaft, the slot of the inner sleeve being formed of a U-shaped extending laterally through the slit of the outer sleeve about the multi-faced cam extension of the shaft to effect the reciprocation of the inner sleeve.

5. A reciprocal cam-powered razor as defined in claim 1 and said handle body having a stem with the drive shaft extending thereinto, the outer end of said stem having a hollow portion extending in an inclined manner therefrom and beyond the cam extension, said cutting head being mounted in the out end of the inclined portion, a lever pivotally connected in the inclined portion and extending from the inner sleeve and having a slotted end receiving the cam extension to be activated whereby the cutting head laterally removed from the handle body.

6. A reciprocal cam-powered razor as defined in claim 1 and said handle body having a stem with the drive shaft extending therethrough, said hair cutting head including a transverse bar portion extending across the end of said stem, said outer cutting sleeve carried by the transverse bar, an inner cutting sleeve being slit and having notches in the side edges of the slit sleeve, said notches being substantially closed within the sleeve assembly, said cam extension operable in the closed notches to reciprocate the inner sleeve within the outer sleeve to effect the shaving operation.

7. A reciprocal cam-powered razor as defined in claim 1 and said cutting head including a stem and drive shaft extension with the multi-faced cam thereon, said drive shaft on the handle body having a drive connection cooperable with the drive shaft extension of the stem and quick detachable means for releasably connecting the stem with the cutting sleeves to the handle body and the drive shaft extension with the handle body drive shaft.

8. A reciprocal cam-powered razor as defined in claim 7 and said handle body shaft and shaft extension axially adjustably connected to one another and having a plurality of differently-sided axially assembled upon one another and latch means connected between the shaft extension and the stem to locate a cam singly in the slot in the inner sleeve and for holding the shaft extension in its adjusted positon.

* * * * *